US007764024B2

(12) United States Patent
Cheng et al.

(10) Patent No.: US 7,764,024 B2
(45) Date of Patent: Jul. 27, 2010

(54) PIEZOELECTRIC TRANSFORMER MODULE FOR GENERATING BALANCE RESONANCE DRIVING CURRENT AND RELATED LIGHT MODULE

(75) Inventors: Yung-tse Cheng, Hsin-Chu (TW); Chih-wei Wang, Hsin-Chu (TW); Hung-min Shih, Hsin-Chu (TW); Tsung-shiun Lee, Hsin-Chu (TW)

(73) Assignee: AU Optronics Corp., Hsin-Chu (TW)

( * ) Notice: Subject to any disclaimer, the term of this patent is extended or adjusted under 35 U.S.C. 154(b) by 70 days.

(21) Appl. No.: 11/743,436

(22) Filed: May 2, 2007

(65) Prior Publication Data

US 2008/0067949 A1 Mar. 20, 2008

(30) Foreign Application Priority Data

Sep. 15, 2006 (TW) ..... 95134369 A

(51) Int. Cl.
*H05B 37/02* (2006.01)

(52) U.S. Cl. ..... 315/291; 315/307; 315/308; 315/246

(58) Field of Classification Search ..... 363/21.02, 363/65, 84, 97, 131, 132, 134; 315/5, 209 R, 315/209 PZ, 224, 246, 247, 274, 276, 277, 315/291, 307, 308, 312, DIG. 5; 310/311, 310/314, 313 R, 316.01, 316.02, 317, 318, 310/319, 320, 322, 323.03, 325, 328, 331, 310/334, 340, 345, 348, 351, 352, 354, 357, 310/358, 359, 360, 363, 364, 365, 366, 367, 310/369, 370; 501/134, 135, 136
See application file for complete search history.

(56) References Cited

U.S. PATENT DOCUMENTS

| | | | | |
|---|---|---|---|---|
| 6,717,372 | B2 | 4/2004 | Lin et al. | |
| 6,724,126 | B2 | 4/2004 | Chou | |
| 6,791,239 | B2 | 9/2004 | Chou et al. | |
| 6,914,365 | B1 | 7/2005 | Chou et al. | |
| 7,042,171 | B1 | 5/2006 | Lin | |
| 7,315,464 | B2 * | 1/2008 | Sawada et al. | 363/159 |

* cited by examiner

*Primary Examiner*—Douglas W Owens
*Assistant Examiner*—Jae K Kim

(57) ABSTRACT

A light module includes a plurality of light sources for generating light, a power controller, a bridge converter, a first piezoelectric transformer, a second piezoelectric transformer, a resonance balance circuit, and a protection circuit. The power controller is used for generating a power driving signal based on a control signal. The bridge converter is used for generating a supply voltage signal based on the power driving signal. The first piezoelectric transformer is used for transforming the supply voltage signal into a first driving voltage signal to a first end of each of the plurality of lamps. The second piezoelectric transformer is used for transforming the supply voltage signal into a second driving voltage signal to a second end of each of the plurality of lamps. The resonance balance circuit includes a primary winding coupled to the first and the second piezoelectric transformers, and a secondary winding for outputting a feedback signal in response to a current flowing through the primary winding. The protection circuit is coupled to the secondary winding of the resonance balance circuit, and is used for generating the control signal based on the feedback signal.

17 Claims, 4 Drawing Sheets

PIEZOELECTRIC TRANSFORMER MODULE FOR GENERATING BALANCE RESONANCE DRIVING CURRENT AND RELATED LIGHT MODULE

1. FIELD OF THE INVENTION

The present invention relates to a piezoelectric transformer module, and more particularly, to a piezoelectric transformer module having multiple piezoelectric transformers to generate balance resonance driving currents to a plurality of lamps.

2. DESCRIPTION OF THE PRIOR ART

Recently, Cold Cathode Fluorescent Lamps (CCFLs) as a backlight illumination source is commonly used in liquid crystal displays. In general, a piezoelectric transformer is used to drive a Cold Cathode Fluorescent Lamp rather than a magnetic transformer. The piezoelectric transformer is attractive for use as a backlight power source for the liquid crystal display because of the compact design and low cost thereof. The piezoelectric transformer is a device in which an alternating voltage of a resonance frequency is applied to a primary electrode to cause a mechanical vibration by resonance. However, when transformers of a piezoelectric inverter drive multiple lamps to light up, it is possible that impedance mismatch between an equivalent capacitor of the primary winding of each piezoelectric transformer and an inductor serving as a resonant element, causing a resonant frequency deviation among output voltages (or currents) of the piezoelectric transformers. This phenomenon results in unevenness of luminance of each cold cathode fluorescent lamp, and causes bad display quality accordingly.

U.S. Pat. No. 6,914,365 discloses an employment of a single inductor connected with four piezoelectric transformers in parallel scheme. Because the four piezoelectric transformers share the same inductor, the resonant frequencies are accordingly identical. Yet, the four piezoelectric transformers fail to balance currents due to various equivalent capacitor of the primary winding of the four piezoelectric transformers. This possibly results in burnout of one of the piezoelectric transformers. In another aspect, U.S. Pat. No. 6,724,126 discloses a device for driving multiple lamps that employs two piezoelectric transformers and two inductors L1, each inductors corresponding to a piezoelectric transformer. However, the two piezoelectric transformers of the device have different resonant frequencies, and output different amount of current resulting from different equivalent capacitor of the two piezoelectric transformers. So the output voltage and current of the two piezoelectric transformers are not balanced, and the problem associated with driving multiple lamps still exists.

Therefore, a development of a piezoelectric transformer module which can output balanced currents with the same resonant frequency to simultaneously drive multiple lamps to light up is essential.

SUMMARY OF THE INVENTION

It is therefore an objective of the present invention to provide a light module and a piezoelectric transformer module thereof, capable of providing driving currents and voltages with the same resonant frequency of the lamps.

According to the present invention, a piezoelectric transformer module for driving a first light source and a second light source comprises a first piezoelectric transformer, a second piezoelectric transformer, and a resonance balance circuit. The first piezoelectric transformer is used for transforming a supply voltage signal into a first driving voltage signal to the first light source. The second piezoelectric transformer is used for transforming the supply voltage signal into a second driving voltage signal to the second light source. The resonance balance circuit comprises a primary winding coupled to the first and the second piezoelectric transformers, and a secondary winding for outputting a feedback signal in response to a current flowing through the primary winding to vary the supply voltage signal.

According to the present invention, a light module comprises a plurality of light sources for generating light, a power controller, a bridge converter, a first piezoelectric transformer, a second piezoelectric transformer, a resonance balance circuit, and a protection circuit. The power controller is used for generating a power driving signal based on a control signal. The bridge converter is used for generating a supply voltage signal based on the power driving signal. The first piezoelectric transformer is used for transforming the supply voltage signal into a first driving voltage signal to a first end of each of the plurality of lamps. The second piezoelectric transformer is used for transforming the supply voltage signal into a second driving voltage signal to a second end of each of the plurality of lamps. The resonance balance circuit comprises a primary winding coupled to the first and the second piezoelectric transformers, and a secondary winding for outputting a feedback signal in response to a current flowing through the primary winding. The protection circuit is coupled to the secondary winding of the resonance balance circuit, and is used for generating the control signal based on the feedback signal.

According to the present invention, a light module comprises a plurality of light sources for generating light, a power controller, a bridge converter, a piezoelectric transformer module, and a protection circuit coupled to the power controller. The power controller is used for generating a power driving signal based on a control signal. The bridge converter is used for generating a supply voltage signal based on the power driving signal. The piezoelectric transformer module comprises a plurality of control modules, and each control module comprises a first piezoelectric transformer, a second piezoelectric transformer, and a resonance balance circuit. The first piezoelectric transformer is used for transforming the supply voltage signal into a first driving voltage signal to one of the plurality of lamps. The second piezoelectric transformer is used for transforming the supply voltage signal into a second driving voltage signal to one of the plurality of lamps. The resonance balance circuit has a primary winding coupled to the first and the second piezoelectric transformers, and a secondary winding for outputting a sensing voltage in response to a current flowing through the primary winding. The protection circuit is used for generating the control signal based on the sensing voltages generated from the plurality of control modules.

The present invention will be described with reference to the accompanying drawings, which show various embodiments of the invention and which are incorporated in the specification hereof by reference.

DETAILED DESCRIPTION OF THE INVENTION

Figure 1:
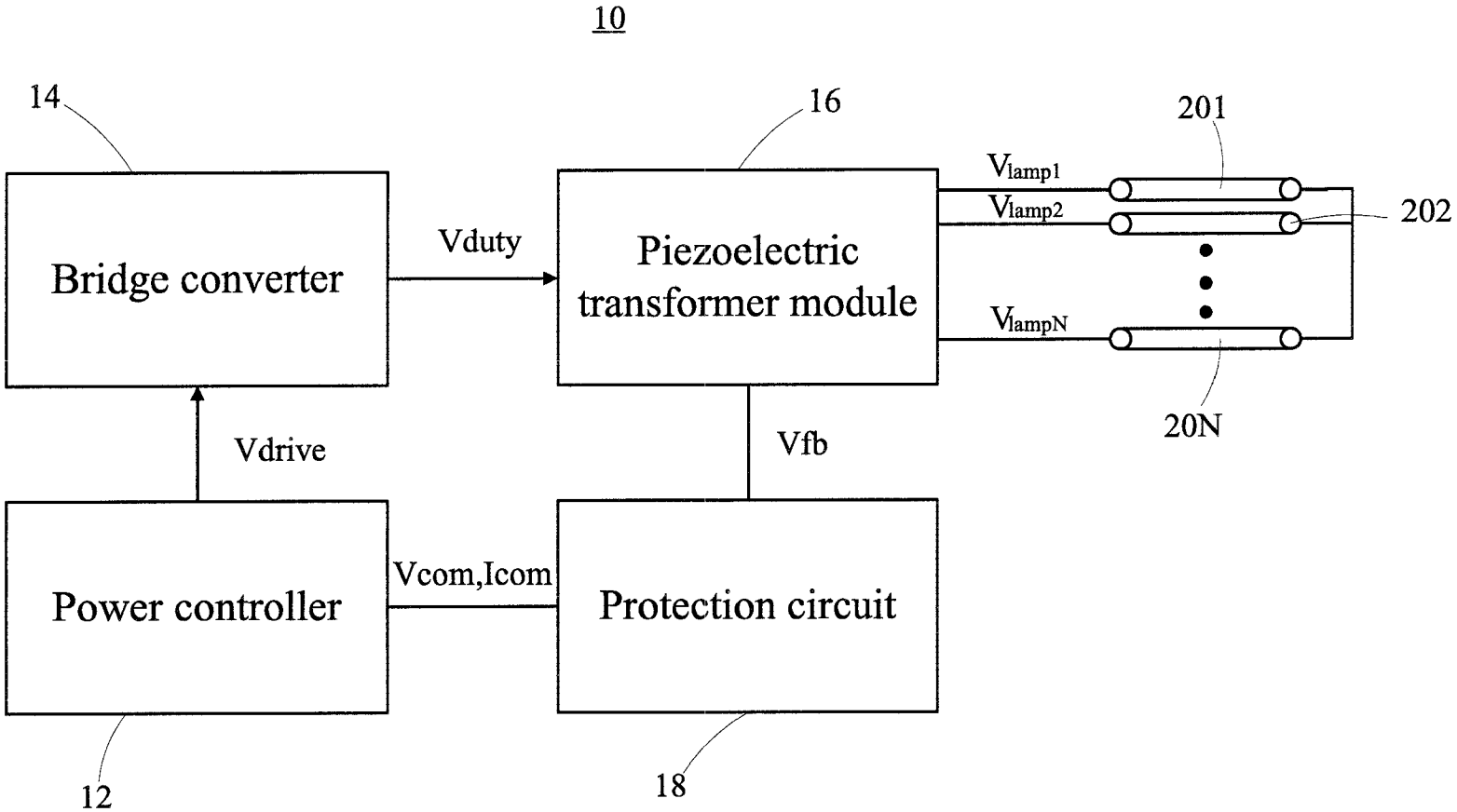
FIG. 1 shows a light module in accordance with the present invention.

FIG. 1 shows a light module 10 in accordance with the present invention. The light module 10 comprises a power controller 12, a bridge converter 14, a piezoelectric transformer module 16, a protection circuit 18 and a plurality of lamps 201-20N. The plurality of lamps 201-20N, which may be Cold Cathode Fluorescent Lamps (CCFLs), External Electrode Fluorescent Lamps (EEFLs), or flat lamps, are used for generating light based on a driving voltage signal from the piezoelectric transformer module 16. The power controller 12 determines a digital power driving signal Vdrive having a variable width based on a control signal Icom from the protection circuit 18, and outputs the digital power driving signal Vdrive to the bridge converter 14. Moreover, the power controller 12 further determines whether the plurality of lamps 201-20N is either a short-circuit or an open-circuit based on a voltage protecting signal Vcom from the protection circuit 18. When one of the lamps 201-20N occurs in open-circuit or short-circuit, the power controller 12 will be shutdown in response to the voltage protecting signal.

The bridge converter 14 outputs the supply voltage signal Vduty to the piezoelectric transformer module 16 based on the digital power driving signal Vdrive. The duty cycle of the supply voltage signal Vduty is determined by a phase difference of the power driving signal. The piezoelectric transformer module 16 receives the supply voltage signal Vduty, and outputs driving voltages Vlamp1-VlampN with the same resonant frequency to the plurality of lamps 201-20N, thereby the lamps 201-20N working under steady driving voltages Vlamp1-VlampN. The bridge converter 14 can be a full-bridge converter, a half-bridge converter, or a push-pull converter. The light module 10 is for use in a liquid crystal display as a backlight source, or in any devices in need of multiple lamps as light sources.

Figure 2:
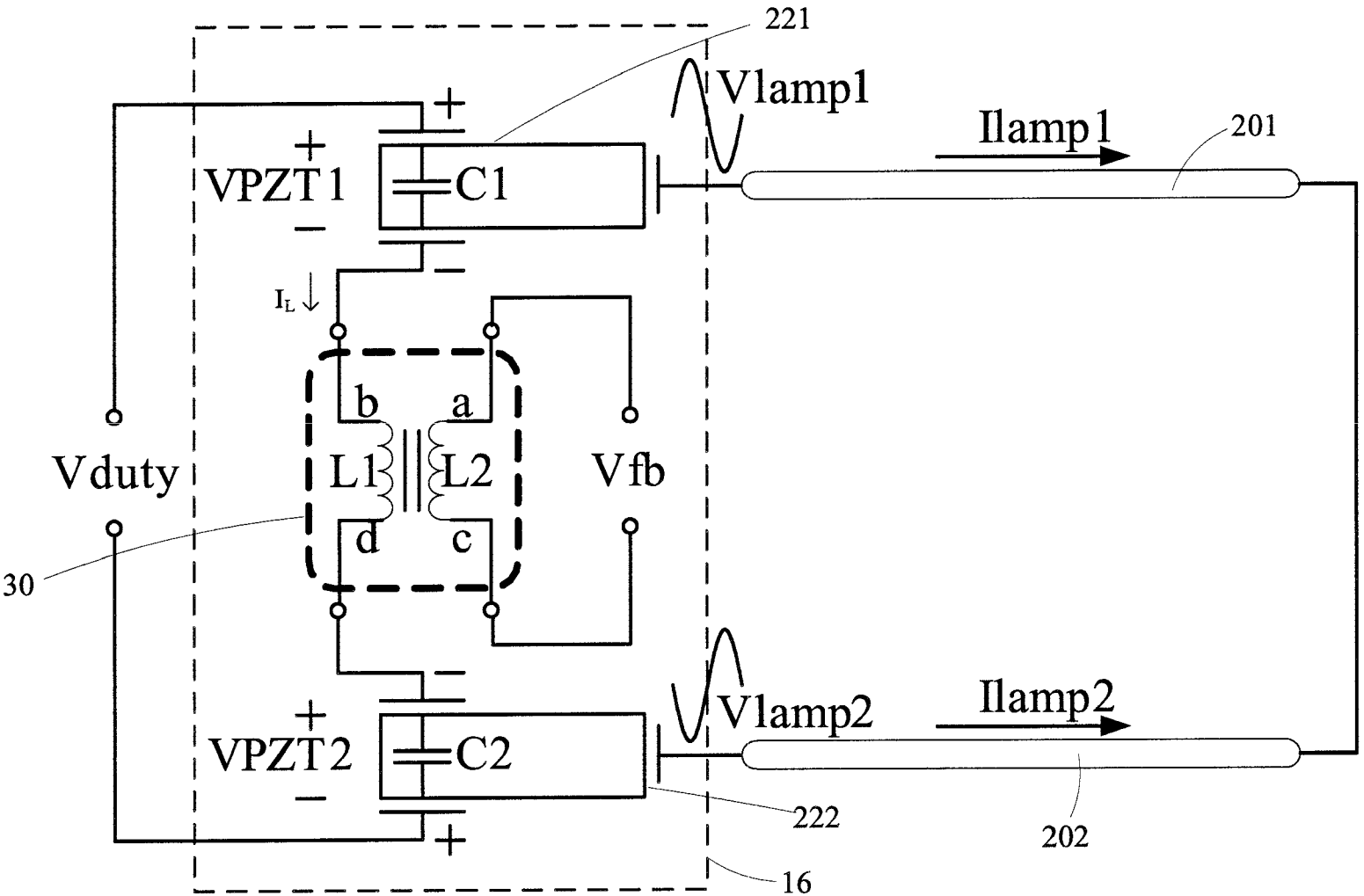
FIG. 2 is a schematic diagram of the piezoelectric transformer module and the plurality of lamps according to the first embodiment of the present invention.

Referring to FIGS. 1 and 2, FIG. 2 is a schematic diagram of the piezoelectric transformer module 16 and the plurality of lamps 201-202 according to the first embodiment of the present invention. The piezoelectric transformer module 16 comprises a first piezoelectric transformer 221, a second piezoelectric transformer 222, and a resonance balance circuit 30. The first piezoelectric transformer 221 and the second piezoelectric transformer 222 transforms the supply voltage signal Vduty into the first and second driving voltage signals Vlamp1, Vlamp2, and thus output the first and second driving voltage signals Vlamp1, Vlamp2 to the lamps 201, 202, respectively. Generally speaking, a phase difference between the first and second driving voltage signals Vlamp1, Vlamp2 is 180 degrees. The supply voltage signal Vduty is simultaneously fed to an positive end of the first piezoelectric transformer 221 and a negative end of the second piezoelectric transformer 222. Moreover, a resonance balance circuit (e.g. a winding transformer 30) is coupled between a negative end of the first piezoelectric transformer 221 and a positive end of the second piezoelectric transformer 222. The winding transformer 30 comprises a primary winding (coils b-d) and a secondary winding (coils a-c), and the coils ratio of the primary winding and the secondary winding may be 1:1, 1:N, or N:1, relying on the designers' requirement. The primary winding (coils b-d) is equivalent to a resonant inductor L1.

The supply voltage signal Vduty is divided into the input voltage VPZT1 of the first piezoelectric transformer 221 and the input voltage VPZT2 of the second piezoelectric transformer 222. The first driving voltage signals Vlamp1 is transformed from the input voltage VPZT1 and has a resonant frequency which is related to a product of an inductance of the resonant inductor L1 and a capacitance C1 of the first piezoelectric transformer 221. In addition, the second driving voltage signal Vlamp2 is transformed from the input voltage VPZT2 and has a resonant frequency which is related to a product of the inductance of the resonant inductor L1 and a capacitance C2 of the second piezoelectric transformer 222. The driving voltage signals Vlamp1 and Vlamp2 drive the lamps 201, 202 to light up. Because both the piezoelectric transformers 221, 222 couple to the resonant inductor L1 (i.e. coils b-d), the driving voltage signals Vlamp1, Vlamp2 of the piezoelectric transformers 221, 222 and currents Ilamp1, Ilamp2 flowing through the lamps 201, 202 have identical resonant frequencies accordingly.

When a current $I_L$ flows through the coils b-d of the transformer 30, a feedback signal Vfb across the coils a-c is induced due to electromagnetic coupling effect, and is delivered to the protection circuit 18. The protection circuit 18 generates the control signal Icom based on the feedback signal Vfb to feedback-control the light module 10.

If the output end of the lamp 201 is an open-circuit, the magnitude of the driving voltage signal Vlamp1 will rapidly increase, and the current $I_L$ flowing through the piezoelectric transformer 221 also increases. Similarly, if the output end of the lamp 201 is a short-circuit, the output current of the piezoelectric transformers 221 increases as well as the current $I_L$ flowing through the piezoelectric transformer 221 also increases. In other words, regardless either of the piezoelectric transformers 221, 222 is an open-circuit or short-circuit, the current $I_L$ flowing through the piezoelectric transformers 221, 222 is incremented as well as the feedback signal Vfb is incremented. Therefore, when detecting a magnitude of the feedback signal Vfb exceeds a predetermined value, the protection circuit 18 generates a voltage protecting signal Vcom to the power controller 12 to stop generating the power driving signal. By doing so, the light module 10 is shutdown.

Figure 3:
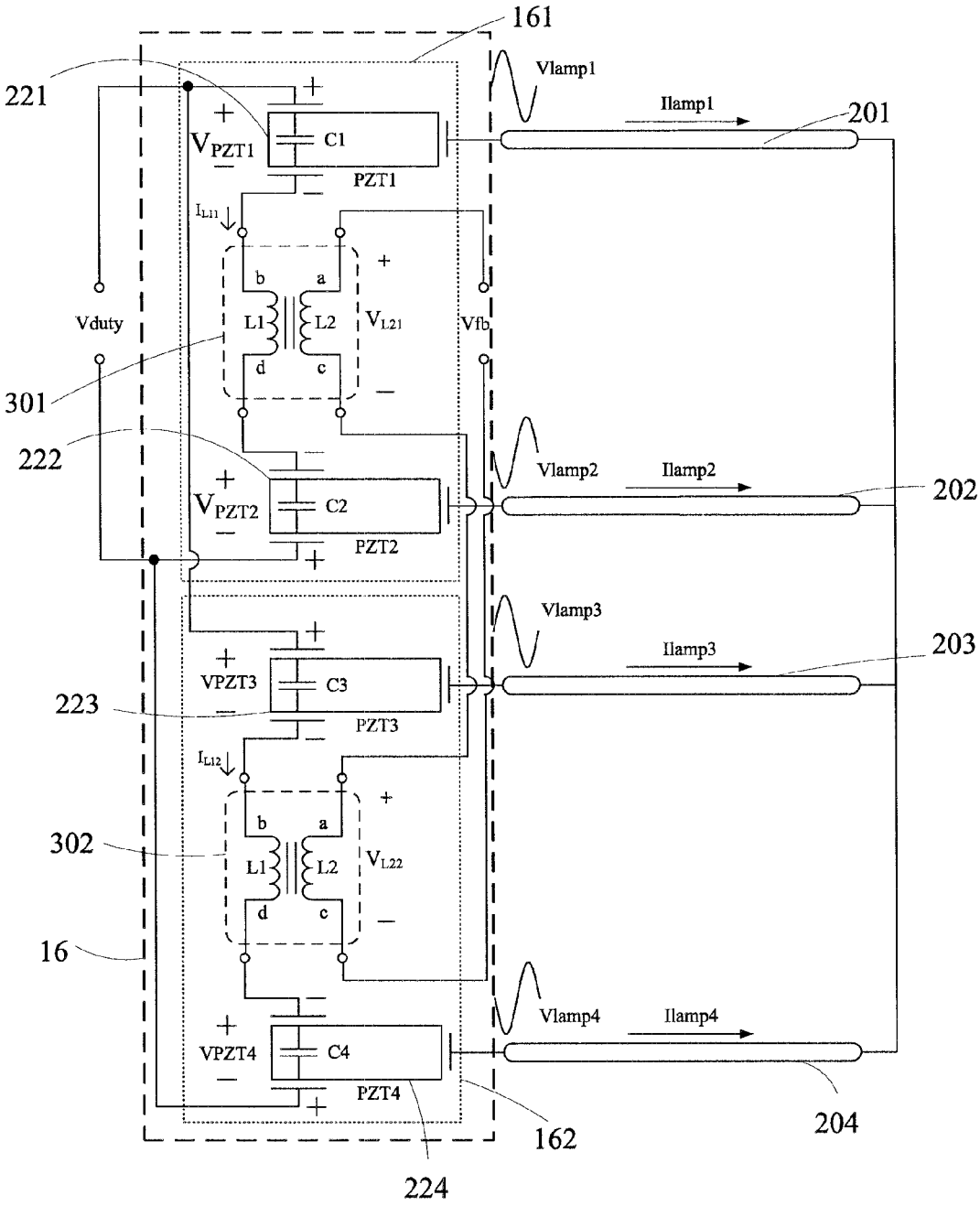
FIG. 3 is a schematic diagram of the piezoelectric transformer module and the plurality of lamps according to the second embodiment of the present invention.

FIG. 3 is a schematic diagram of the piezoelectric transformer module 16 and the plurality of lamps 201-204 according to the second embodiment of the present invention. The piezoelectric transformer module 16 is used for driving four lamps 201-204. The piezoelectric transformer module 16 comprises a first control module 161 and a second control module 162. The first control module 161 comprises two piezoelectric transformers 221, 222 and a resonance balance circuit (e.g. winding transformer 301), while the second control module comprises two piezoelectric transformers 223, 224 and a resonance balance circuit (e.g. winding transformer 302). The winding transformer 301 is coupled between a negative input end of the piezoelectric transformers 221 and a positive input end of the piezoelectric transformers 222. The winding transformer 302 is coupled between a negative input end of the piezoelectric transformers 223 and a positive input end of the piezoelectric transformers 224. Accordingly, the winding transformer 301 functions as a resonant element of the piezoelectric transformers 221, 222, and the winding transformer 302 functions as a resonant element of the piezoelectric transformers 223, 224. The supply voltage signal Vduty is divided as input voltages VPZT1, VPZT2, VPZT3 and VPZT4 of the respective piezoelectric transformers 221, 222, 223, 224. Each piezoelectric transformer 221, 222, 223, 224 outputs an alternating current (AC) driving voltage signal Vlamp1, Vlamp2, Vlamp3, Vlamp4 to turn on the lamps 201, 202, 203, 204, respectively. The piezoelectric transformers 221, 222 are coupled to the resonant inductor L1 of the winding transformer 301, so the outputs have the same resonant frequency. Similarly, the piezoelectric transformers 223, 224 are coupled to the resonant inductor L1 of the winding transformer 302, so the outputs have the same resonant frequency. A magnitude of the feedback signal Vfb is a sum of sensing output voltage $V_{L21}$ across the a-c winding of the transformer 301 and sensing output voltage $V_{L22}$ across the a-c winding of the transformer 302, so an amount of the current $I_{L11}$ flowing through C1, L1, C2 and an amount of the current $I_{L12}$ flowing through C3, L1, C4 are changed as an adjustment of the feedback signal Vfb. Through the adjustment of the feedback signal Vfb, the driving currents Ilamp1, Ilamp2, Ilamp3, Ilamp4 generated by the respective piezoelectric transformers 221, 222, 223, 224 are controlled.

In addition, once either outputs of the piezoelectric transformers is an open-circuit or short-circuit, the feedback signal Vfb is incremented. When detecting a magnitude of the feedback signal Vfb exceeds a predetermined value, the protection circuit 18 generates a voltage protecting signal Vcom to the power controller 12 to shutdown the light module 10.

Figure 4:
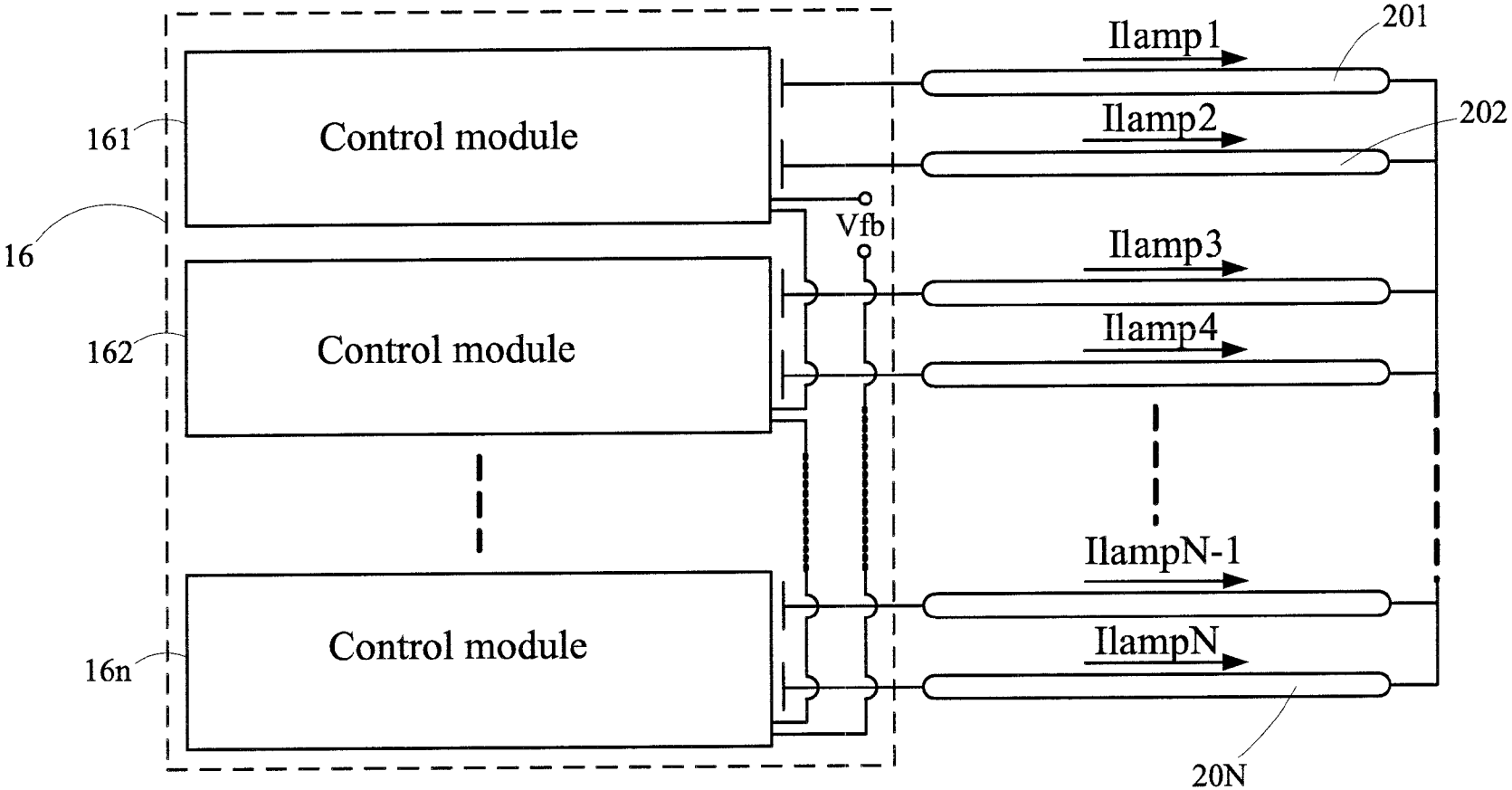
FIG. 4 is a schematic diagram of a piezoelectric transformer module and a plurality of lamps according to the third embodiment of the present invention.

FIG. 4 shows a schematic diagram of a piezoelectric transformer module 16 and a plurality of lamps 201-20N according to the third embodiment of the present invention. The piezoelectric transformer module 16 comprises a plurality of control modules 161-16*n*, and each control module comprises two piezoelectric transformers and a resonance balance circuit (e.g. winding transformer). Each piezoelectric transformer is used for driving a lamp to light up. In other words, the piezoelectric transformers of each control module can output driving voltage signals with the same resonant frequency, such that the piezoelectric transformer module 16 can simultaneously drive the plurality of lamps to light up. Also, the resonance balance circuit of each control module can generate a sensing voltage across the secondary winding, based on the current flowing through the primary winding. Similar to the operation principle of FIG. 3, when detecting a magnitude of the feedback signal Vfb (i.e. a sum of sensing voltages of the resonance balance circuits of all control modules) exceeds a predetermined value, the protection circuit 18 generates a voltage protecting signal Vcom to the power controller 12 to stop generating the power driving signal. By doing so, the light module 10 is shutdown.

The light module 10 can be applied in a liquid crystal display and are used for driving the plurality of lamps (e.g. Cold Cathode Fluorescent Lamps, External Electrode Fluorescent Lamps, or flat lamps) to emit sufficient backlight for the liquid crystal panel.

In contrast to prior art, the present invention provides a light module having one or more piezoelectric transformer modules. Each piezoelectric transformer module comprises a plurality of piezoelectric transformers coupled to a resonance balance circuit, so that all piezoelectric transformers are capable of outputting driving voltage signals with the same resonant frequency to the lamps. This facilitates efficiency for driving lamps. Furthermore, for the purpose on determining whether any lamp is malfunction, the light module also comprises a protection circuit for detecting a feedback signal generated from the resonance balance circuit. Once the feedback signal exceeds a predetermined value, the protection circuit can control the power signal to stop outputting power signal, to turn off the lamps.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A piezoelectric transformer module for driving a first light source having a first end and a second end, and for driving a second light source having a third end and a fourth end, the second end connecting to the fourth end, the piezoelectric transformer module, comprising:

a first piezoelectric transformer for transforming a supply voltage signal into a first driving voltage signal to the first light source, wherein the first piezoelectric transformer comprises a first terminal, a second terminal, and a third terminal, and wherein the third terminal is connected to the first end of the first light source;

a second piezoelectric transformer for transforming the supply voltage signal into a second driving voltage signal to the second light source, wherein the second piezoelectric transformer comprises a fourth terminal, a fifth terminal, and a sixth terminal, and wherein the sixth terminal is connected to the third end of the second light source; and a resonance balance circuit having a primary winding directly connected to the first and the second piezoelectric transformers, and a secondary winding for outputting a feedback signal in response to a current flowing through the primary winding to vary the supply voltage signal, wherein the primary winding comprises two ends, wherein one of the two ends is connected directly to the second terminal of the first piezoelectric transformer and the other end is connected directly to the fourth terminal of the second piezoelectric transformer.

2. The piezoelectric transformer module of claim 1, wherein the number of coils of the primary winding is different from the number of coils of the secondary winding.

3. The piezoelectric transformer module of claim 1, wherein a phase difference between the first driving voltage signal and the second driving voltage signal is 180 degrees.

4. A light module, comprising:

a plurality of light sources for generating light, wherein the plurality of light sources comprise a first light source having a first end and a second end, and a second light source having a third end and a fourth end, the second end connecting to the fourth end;

a power controller for generating a power driving signal based on a control signal;

a bridge converter directly connected to the power controller, for generating a supply voltage signal based on the power driving signal;

a first piezoelectric transformer directly connected to the bridge converter, for transforming the supply voltage signal into a first driving voltage signal to a first end of each of the plurality of light sources, wherein the first piezoelectric transformer comprises a first terminal, a second terminal, and a third terminal, and wherein the third terminal is connected to the first end of the first light source;

a second piezoelectric transformer directly connected to the bridge converter, for transforming the supply voltage signal into a second driving voltage signal to a second end of each of the plurality of light sources, wherein the second piezoelectric transformer comprises a fourth terminal, a fifth terminal, and a sixth terminal, and wherein the sixth terminal is connected to the third end of the second light source;

a resonance balance circuit having a primary winding directly connected to the first and the second piezoelectric transformers, and a secondary winding for outputting a feedback signal in response to a current flowing through the primary winding, wherein the primary winding comprises two ends, wherein one of the two ends is connected directly to the second terminal of the first piezoelectric transformer and the other end is connected directly to the fourth terminal of the second piezoelectric transformer; and a protection circuit, directly connected to the secondary winding of the resonance balance circuit, for generating the control signal based on the feedback signal.

5. The light module of claim 4, wherein the plurality of light sources are Cold Cathode Fluorescent Lamps (CCFLs), External Electrode Fluorescent Lamps (EEFLs), or flat lamps.

6. The light module of claim 4, wherein the protection circuit is configured to generate a voltage protecting signal to the power controller so as to stop generating the power driving signal when a magnitude of the feedback signal exceeds a predetermined value.

7. The light module of claim 4, wherein the number of coils of the primary winding is different from the number of coils of the secondary winding.

8. The light module of claim 4, wherein the bridge converter is configured to generate the supply voltage signal based on a width of the power driving signal.

9. The light module of claim 8, wherein a phase difference between the first driving voltage signal and the second driving signal is 180 degrees.

10. A liquid crystal display comprising the light module of claim 4.

11. A light module comprising:

a plurality of light sources for generating light, wherein the plurality of light sources comprise a first light source having a first end and a second end, and a second light source having a third end and a fourth end, the second end connecting to the fourth end;

a power controller for generating a power driving signal based on a control signal;

a bridge converter directly connected to the power controller, for generating a supply voltage signal based on the power driving signal;

a piezoelectric transformer module comprising a plurality of control modules, each control module comprising:

a first piezoelectric transformer directly connected to the bridge converter, for transforming the supply voltage signal into a first driving voltage signal to one of the plurality of light sources, wherein the first piezoelectric transformer comprises a first terminal, a second terminal, and a third terminal, and wherein the third terminal is connected to the first end of the first light source;

a second piezoelectric transformer directly connected to the bridge converter, for transforming the supply voltage signal into a second driving voltage signal to one of the plurality of light sources, wherein the second piezoelectric transformer comprises a fourth terminal, a fifth terminal, and a sixth terminal, and wherein the sixth terminal is connected to the third end of the second light source; and a resonance balance circuit having a primary winding directly connected to the first and the second piezoelectric transformers, and a secondary winding for outputting a sensing voltage in response to a current flowing through the primary winding, wherein the primary winding comprises two ends, wherein one of the two ends is connected directly to the second terminal of the first piezoelectric transformer and the other end is connected directly to the fourth terminal of the second piezoelectric transformer; and a protection circuit, directly connected to the power controller, for generating the control signal based on the sensing voltages generated from the plurality of control modules.

12. The light module of claim 11, wherein the plurality of light sources are Cold Cathode Fluorescent Lamps (CCFLs), External Electrode Fluorescent Lamps (EEFLs), or flat lamps.

13. The light module of claim 11, wherein the protection circuit is configured to generate a voltage protecting signal to the power controller so as to stop generating the power driving signal when a magnitude of a sum of the sensing voltages of the plurality of control modules exceeds a predetermined value.

14. The light module of claim 11, wherein the number of coils of the primary winding is different from the number of coils of the secondary winding.

15. The light module of claim 11, wherein the bridge converter is configured to generate the supply voltage signal based on a width of the power driving signal.

16. The light module of claim 11, wherein a phase difference between the first driving voltage signal and the second driving signal is 180 degrees.

17. A liquid crystal display comprising the light module of claim 11.

* * * * *